US010881936B2

(12) United States Patent
Machovina et al.

(10) Patent No.: US 10,881,936 B2
(45) **Date of Patent: *Jan. 5, 2021**

(54) EXERCISE ASSEMBLY FOR PERFORMING DIFFERENT ROWING ROUTINES

(71) Applicant: COREYAK LLC, Coral Gables, FL (US)

(72) Inventors: Brian Machovina, Coral Gables, FL (US); Eileen McHale-Machovina, Coral Gables, FL (US)

(73) Assignee: COREYAK LLC, Coral Gables, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,367

(22) Filed: Dec. 4, 2018

(65) Prior Publication Data

US 2019/0099649 A1 Apr. 4, 2019

Related U.S. Application Data

(63) Continuation-in-part of application No. 15/627,740, filed on Jun. 20, 2017, now Pat. No. 10,155,131, (Continued)

(51) Int. Cl.
*A63B 69/06* (2006.01)
*A63B 21/00* (2006.01)
(Continued)

(52) U.S. Cl.
CPC ..... *A63B 69/06* (2013.01); *A63B 21/00069* (2013.01); *A63B 21/0088* (2013.01); (Continued)

(58) Field of Classification Search
CPC ..... A47C 3/027; A47C 3/029; A47C 9/002; A63B 69/06; A63B 2069/062–068; A63B 23/02–0227; A63B 22/14–18
See application file for complete search history.

(56) References Cited

U.S. PATENT DOCUMENTS 1,905,092 A * 4/1933 Hardy ..... A63B 22/0076 482/72
2,725,231 A 11/1955 Hoover
(Continued)

FOREIGN PATENT DOCUMENTS

CN 202654619 1/2013
DE 2639882 3/1978
(Continued)

*Primary Examiner* — Nyca T Nguyen
(74) *Attorney, Agent, or Firm* — Malloy & Malloy, P.L.; Peter A. Matos

(57) ABSTRACT

An exercise assembly structured to perform different rowing routines characterized different rowing motions. A resistance device is movable within a chamber and is cooperatively structured therewith to resist such movement. A drive assembly includes two drive sections each independently connected in driving relation to said resistance device. A connector structure includes two connector members each attached to a handle and connected in driving relation to a different one of said drive sections. The handle is selectively movable through the plurality of different rowing motions, at least one of which results in the two drive sections concurrently driving the resistance member and being concurrently driven by the two connector members. At least one other rowing motion of the handle is defined by each drive section alternately driving the resistance member and being alternately driven by interconnected ones of said connector members.

15 Claims, 11 Drawing Sheets

Related U.S. Application Data which is a continuation-in-part of application No. 15/367,289, filed on Dec. 2, 2016, now Pat. No. 10,556,167.

(60) Provisional application No. 62/419,618, filed on Nov. 9, 2016, provisional application No. 62/352,202, filed on Jun. 20, 2016.

(51) Int. Cl.

| | |
|---|---|
| ***A63B 21/22*** | (2006.01) |
| ***A63B 22/00*** | (2006.01) |
| ***A63B 22/20*** | (2006.01) |
| ***A63B 21/008*** | (2006.01) |

(52) U.S. Cl.

CPC ..... *A63B 21/153* (2013.01); *A63B 21/225* (2013.01); *A63B 22/0076* (2013.01); *A63B 2022/0079* (2013.01); *A63B 2022/206* (2013.01); *A63B 2208/0214* (2013.01)

(56) References Cited

U.S. PATENT DOCUMENTS 3,586,322 A 6/1971 Kverneland
4,396,188 A 8/1983 Dreissigacker et al.
4,537,396 A 8/1985 Hooper
4,625,962 A * 12/1986 Street ..... A63B 21/015 482/116
4,647,035 A 3/1987 Yellen
4,674,741 A 6/1987 Pasierb, Jr. et al.
4,687,197 A 8/1987 Larsson et al.
4,717,145 A 1/1988 Chininis
4,735,410 A 4/1988 Nobuta
4,768,775 A * 9/1988 Marshall ..... A63B 22/0076 482/133
4,772,013 A * 9/1988 Tarlow, Jr. ..... A63B 21/153 482/111
4,798,378 A 1/1989 Jones
4,880,224 A 11/1989 Jonas et al.
4,940,227 A 7/1990 Coffey
4,997,181 A 3/1991 Lo
5,382,210 A * 1/1995 Rekers ..... A63B 21/157 482/125
5,429,564 A * 7/1995 Doane ..... A63B 69/10 434/254
5,565,002 A 10/1996 Rawls et al.
5,624,357 A 4/1997 Englehart et al.
5,803,876 A 9/1998 Hickman
5,820,528 A * 10/1998 McAndrew ..... A63B 21/154 482/72
5,947,868 A 9/1999 Dugan
5,989,157 A 11/1999 Walton
6,196,954 B1 * 3/2001 Chen ..... A63B 22/203 482/131
6,328,677 B1 * 12/2001 Drapeau ..... A63B 22/0076 482/55
6,545,661 B1 4/2003 Goschy et al.
6,561,955 B1 5/2003 Dreissigacker et al.
6,569,065 B1 * 5/2003 Menold ..... A63B 22/0076 482/72
6,663,541 B1 * 12/2003 Yang ..... A63B 21/00181 482/142
6,761,670 B2 * 7/2004 Liou ..... A63B 21/153 482/57
7,192,387 B2 3/2007 Mendel
7,201,708 B2 4/2007 Dreissigacker et al.
7,335,143 B2 2/2008 Lundahl
7,614,987 B2 11/2009 Guadagno
7,628,739 B2 12/2009 Gearon
7,731,637 B2 * 6/2010 D'Eredita ..... A63B 21/154 482/138
7,846,079 B1 12/2010 Eaglin
7,927,253 B2 4/2011 Vincent et al.
7,967,728 B2 6/2011 Zavadsky et al.
8,025,607 B2 9/2011 Ranky et al.
8,042,391 B2 10/2011 Ye
8,060,337 B2 11/2011 Kulach et al.
8,210,997 B2 7/2012 Thomas et al.
8,221,290 B2 7/2012 Vincent et al.
8,239,146 B2 8/2012 Vock et al.
8,241,186 B2 8/2012 Brodess et al.
8,506,458 B2 8/2013 Dugan
8,556,778 B1 10/2013 Dugan
8,560,267 B2 10/2013 Jangle et al.
8,608,626 B2 * 12/2013 Campbell ..... A63B 21/023 482/72
8,622,876 B2 1/2014 Kelliher
8,730,267 B2 5/2014 Petersen
8,740,752 B2 6/2014 Ellis et al.
8,762,077 B2 6/2014 Redmond et al.
8,771,151 B2 7/2014 Larsson
8,784,273 B2 7/2014 Dugan
8,812,258 B2 8/2014 Nadkarni et al.
8,858,399 B2 10/2014 Ellis et al.
8,876,738 B1 11/2014 Kahn et al.
8,882,639 B2 11/2014 Tchao et al.
8,920,287 B2 12/2014 Doshi et al.
8,939,831 B2 1/2015 Dugan
9,089,733 B2 7/2015 Fisbein et al.
9,171,201 B2 10/2015 Lake, II et al.
9,623,279 B2 4/2017 Domeika
9,770,622 B2 * 9/2017 Campanaro ..... A63B 22/0089
9,788,659 B1 * 10/2017 Jen ..... A47C 9/002
10,155,131 B2 * 12/2018 Machovina ..... A63B 22/0076
10,449,410 B2 * 10/2019 Hamilton ..... A63B 21/157
2003/0134719 A1 7/2003 Liou
2004/0142802 A1 * 7/2004 Greenspan ..... A61H 1/0237 482/146
2005/0277521 A1 * 12/2005 Lat ..... A63B 21/154 482/72
2007/0232460 A1 * 10/2007 Nguyen ..... A63B 21/00178 482/92
2008/0280736 A1 * 11/2008 D'Eredita ..... A63B 21/154 482/72
2008/0300520 A1 * 12/2008 Shin ..... A61H 1/003 601/49
2009/0018000 A1 * 1/2009 Brown ..... A63B 21/068 482/140
2009/0203503 A1 * 8/2009 Gothro ..... A63B 22/16 482/72
2010/0190615 A1 7/2010 Baker et al.
2010/0197462 A1 8/2010 Piane, Jr.
2010/0240494 A1 9/2010 Medina
2011/0028278 A1 2/2011 Roach
2011/0082015 A1 4/2011 Dreissigacker et al.
2012/0100965 A1 * 4/2012 Dreissigacker ..... A63B 22/001 482/72
2013/0109538 A1 * 5/2013 Ho ..... A63B 71/0622 482/8
2013/0150220 A1 * 6/2013 Chen ..... A63B 22/18 482/146
2013/0225374 A1 * 8/2013 Lumsden ..... A63B 22/0076 482/72
2014/0018218 A1 * 1/2014 Chen ..... A63B 22/18 482/146
2014/0179498 A1 * 6/2014 Lalaoua ..... A63B 21/02 482/131
2014/0256526 A1 * 9/2014 Henson ..... A63B 22/18 482/146
2015/0111706 A1 * 4/2015 Broadhurst ..... A63B 22/0076 482/72
2015/0258366 A1 9/2015 Domeika
2016/0144223 A1 * 5/2016 Dalebout ..... A63B 22/0076 482/72
2016/0263424 A1 * 9/2016 LaCaze ..... A63B 23/0355
2016/0375297 A1 * 12/2016 Kiser ..... A63B 22/0076 482/73
2017/0014667 A1 * 1/2017 Barnett ..... A63B 23/0211
2017/0165552 A1 * 6/2017 Martin ..... A63B 69/06
2017/0319889 A1 * 11/2017 Cei ..... A63B 21/00072
2018/0056118 A1 * 3/2018 Bates ..... A63B 21/154

(56) References Cited

U.S. PATENT DOCUMENTS

| | | | | |
|---|---|---|---|---|
| 2018/0064988 | A1* | 3/2018 | Xu | A63B 23/0238 |
| 2018/0099178 | A1* | 4/2018 | Schaefer | A63B 22/0087 |
| 2019/0054343 | A1* | 2/2019 | Chiang | A63B 22/0076 |
| 2019/0099649 | A1 | 4/2019 | Machovina | |

FOREIGN PATENT DOCUMENTS

| | | |
|---|---|---|
| DE | 202004003201 | 6/2004 |
| DE | 102010012519 | 9/2011 |
| EP | 1557205 | 7/2005 |
| WO | WO 92/00780 | 1/1992 |
| WO | WO 2004/112918 | 12/2004 |
| WO | WO 2017/223040 | 12/2017 |

* cited by examiner

EXERCISE ASSEMBLY FOR PERFORMING DIFFERENT ROWING ROUTINES

CLAIM OF PRIORITY

The present application is a continuation-in-part application of U.S. patent application Ser. No. 15/627,740, filed on Jun. 20, 2017, which is a continuation-in-part application of U.S. patent application Ser. No. 15/367,289, filed on Dec. 2, 2016, which claims priority to U.S. Provi. Pat. App. No. 62/352,202, filed on Jun. 20, 2016, as well as to U.S. Provi. Pat. App. No. 62/419,618, filed on Nov. 9, 2016, the contents of which are both incorporated herein by reference in their entireties.

BACKGROUND OF THE INVENTION

Field of the Invention

The present invention relates to novel land-based exercise devices that replicate the motion of kayaking and rowing. More particularly, the invention is related to an exercise device that replicates both the motion and resistance of kayaking and rowing and translates motion of the device's paddle handle into immediate corresponding motion of kayaking or rowing movement displayed in video games, videos, virtual reality videos and/or fitness tracking software.

Description of the Related Art

Physical fitness is generally considered to be beneficial to almost all individuals, from the elderly to the relatively young. The benefits of physical fitness results in an improvement in overhaul health as at least partially demonstrated by a decrease in the risk of contracting diseases, the avoidance of injury when involved in either strenuous or normal activities and the overall improvement in the quality of life. Further, involved in physical fitness activities, one usually attempts to improve body flexibility, muscular strength, and improvement in metabolic rate, cardiovascular endurance and the reduction of body fat. It is also generally accepted that physical fitness, through exercise plays a significant role in maintaining and improving and individuals mental health.

Attempts to improve one's physical fitness typically involves the performance of specialized or generalized exercise routines. As such, many such routines can be performed outdoors without the need for specialized equipment. By way of example, running or walking on a consistent basis is a well-known method of increasing one's physical fitness specifically including, but not limited to cardiovascular improvement. However, many individuals attempt to improve the physical condition of specific parts of their body and or muscle groupings in order to improve their ability to perform certain sports and or physical activities.

As an example, weight training specifically provides many functional benefits. As such weight training strengthens muscles to improve posture and provide better support for joints. Further, weight training may increase muscle mass which in turn may result in an elevation in metabolism, a weight loss and in certain more specialized situations helps one in the performance of certain sports activities.

Accordingly, some areas of physical training or exercise preferably involves the use of exercise equipment and/or machinery. Generally speaking, exercise equipment of this type generally provides a user with a degree of resistance to movement or user motion, whether the ultimate goal is building muscle mass of certain muscle groupings or increasing one's endurance. In either instance, the degree of resistance presented by specialized exercise equipment is almost always selectively variable such that different training routines and or the development of certain muscle groupings can be more efficiently and effectively accomplished.

Further by way of example, more specialized exercise machines and/or equipment are structured and operative to facilitate a user's performance of a rowing motion. Moreover, these types of exercise machines/equipment may be even more specialized depending upon the type of rowing action or motion preferred to be practiced by a user. The sport of rowing has long been recognized as an excellent form of exercise. As such, one who engages in either casual or competitive rowing can efficiently develop his/her legs, back, shoulders, arms and other areas of the body, by exercising with such rowing machines. If properly designed and operational, such rowing machines involve little trauma to the user by avoiding a pounding or like dramatic effect to the user's body. Further, known or existing rowing machines may be relatively compact and even portable as they have been adapted for use in indoor locations.

However, many known or conventional rowing machines provide user with relatively limited versatility in that many do not enable a user to perform a true rowing action corresponding to that if the user was in an actual rowboat, canoe or other preferred watercraft. In other words, the movements or motions of a user when operating such rowing machines often do not duplicate an actual or real life rowing motion. Further, many known or conventional machines of this type are not capable of meaningful or selective adjustment which allow a user to change between different rowing routines, while concurrently making adjustments to accommodate the strength, size, age, etc. of different users.

Therefore, there is a need in the exercise industry and in the general area of enhancing physical fitness for an exercise assembly capable of facilitating the performance of a variety of different rowing routines. In addition, the plurality of different rowing routines made available to a user would more closely resemble a true or real life rowing motion. As such, the different rowing motions may replicate different routines including, but not limited to, the paddling of a canoe or kayak or the motion associate with a typical row boat, wherein a user concurrently operates two rowing oars. Further, such a preferred and proposed exercise assembly should be capable of being easily changed or switched in its practiced motion such that a user may quickly and efficiently switch to a different one of a possible plurality of rowing routines such as those set forth above.

In addition, such a preferred and proposed exercise assembly should include variable resistance features to accommodate different users as well as facilitate the performance of the different rowing routines of the type indicated. Also, such a proposed exercise assembly should be sufficiently versatile and effectively operable to analyze and convert any of a plurality of different rowing motions into a digital display which in turn could be incorporated into a videogame, video program, three-dimensional virtual reality, fitness tracking program, etc.

SUMMARY OF THE INVENTION

The present invention is directed to an exercise assembly enabling a user to be seated upon the floor and/or floor supported chair or seat structure. When so disposed, the user may attempt to replicate the rowing motion and physical resistance of kayaking or rowing and translate the motion of a paddle/handle of the exercise assembly into immediate corresponding motion of kayaking or rowing movement displayed in video games, videos, virtual reality videos and/or fitness tracking software.

Exercise is performed by a user pulling on the paddle/handle with a connector structure, including a connector member attached to each of the paddle handle terminal ends. The other ends of the connector members enter the interior of the housing of the exercise assembly and are coiled around pulley members that, through individual drive axels and 4:1 gear linkage, turn a second driven axel attached driving relation to a resistance member, such as a fan structure, inside and the air chamber. Rotating fan blades push against atmospheric pressure of the air within the interior of the air chamber and thereby providing resistance to the users' motion. The amount of air resistance against the fan blades is adjustable by variably opening or closing vents that control the amount of airflow between the fan chamber and the exterior of the device. Adjusting the amount of airflow into the chamber adjusts the level of difficulty for a user to pull the paddle/handle. As either end of the paddle handle is pulled, the connector member attached to the same paddle handle terminus turns a pulley on a corresponding one of the drive sections of the drive assembly. Each pulley is attached to a separate first drive axle, which is attached to a drive gear. Each of the drive gears are disposed into meshing, driving engagement with a correspondingly disposed driven gear connected to and rotational with a driven axle. When pulling motion on one or both of the pulley stops, the resistance device and/or fan structure continues to spin via a clutch and/or freewheel mechanism incorporated into the pulley systems and/or linkage associated with the drive sections. When pulling motion is reversed, a coiled tension spring integrated into the pulley system rotates the pulley in the opposite direction and retracts the strap to wind back around the pulley.

A user sits upon the ground or a seat in front of the housing of the exercise assembly and places their feet upon the foot or retention plates associated there with. The device sits upon a movable support which may include a plurality of wheels, castors, rollers, etc. Moreover, the movable support can be set in a locked (unmovable) or unlocked (movable) orientation. When performing kayaking exercises, the movable supports are placed in the locked position.

During kayaking exercises, a seat which may be composed of a fabric bottom and backrest can be attached to the device via straps, providing back support for the user. The shape of the lower surface of the seat can be altered by attaching different panels to the lower surface of the seat. The flat upper surface of the panels connects via clips and straps to the flat lower surface of seat. The lower surface of the panels can be constructed of a variety of curved shapes or inflatable elastic material which enable the seat to tilt on the ground in a portion of or full 360 degrees. Countering this tilting motion engages muscles of the user. When wheels are unlocked, the device can roll forward and backward on the ground. Rowing-device type exercises can be performed on the device when the wheels are unlocked and the user pulls equally on both sides of the paddle handle while extending the legs away from their body while in a seated position. This movement pushes the device away from the user. Straps on the foot rests that secure the user's feet to the foot rests enable the device to be pulled back toward the user while the pulley mechanism retracts the straps onto the pulleys.

Attached to the paddle/handle is a motion sensor which may include an accelerometer, gyroscope, etc. and wireless communication such as, but not limited to, Bluetooth capabilities device that tracks the 3-dimensional movement of the paddle and transmits the motion of the paddle/handle to a nearby processor/display assembly including, but not limited to, smartphones, tablets, or virtual reality goggles. Such display devices may include software which translates and integrates the movement information or "motion data" into matching 3-dimensional paddle movement and projected 3-dimensional movement of a kayaker or rower and/or a kayak and/or rowing boat displayed within video games, videos, virtual reality videos, and fitness tracking software. The motion data from the accelerometer, gyroscope, etc, can be interpreted by the processor/software associated with the display assembly to display kayaker/rower and kayak/rowing boat movement tracking and fitness measurement and information including, but not limited to, number of paddle strokes, speed of boat movement, distance traveled, power of strokes.

In more specific terms, the exercise assembly of the present invention is structured to perform a plurality of different rowing routines, where in each rowing routine is defined or characterized by at least one different rowing motion. By way of example only, a rowing motion associated with "kayaking" may typically include a user moving a handle in the manner commonly associated with a kayak paddle. As such, different blades or ends of a kayak paddle will alternately enter the water to propel the kayak forward. In contrast, a conventional rowing motion associated with a typical row boat will define a different routine. As such, the rowing motion associated with the propulsion of a rowboat typically involves the movement of the handle of the exercise assembly, by a user, in a manner resulting in both "oars" associated with the rowboat being concurrently moved. Therefore, such a rowing motion associated with a rowboat routine will in the blade end of each "oar" concurrently entering the water.

As generally recognized and set forth above, the "rowing motion" associated with kayaking differs significantly from the rowing motion associated with the propulsion of a conventional rowboat. Therefore, the rowing motion of a user of the exercise assembly of the present invention will move the handle in the same manner as he/she would move the paddle or oars if actually kayaking, rowing, etc. As a result, each of a possible plurality of different rowing motions of the handle, performed by the user, will represent a different "rowing routine". Therefore, the exercise assembly of the present invention demonstrates an enhanced versatility in allowing a user to perform different rowing routines depending on his/her preference.

As set forth in greater detail hereinafter, structural and operational components of one or more preferred embodiments of the exercise assembly of the present invention includes a movable or rotational chamber. The chamber may be more specifically defined as an air chamber through which a flow of air passes, while being at least partially, temporarily retained or captured therein. A resistance element is removably or more specifically rotationally mounted within the air chamber and is structured to resist rotation therein due to interaction with the flow or at least partially retained air within the air chamber. As such, the resistance device made assume a fan or fan-like structure having a plurality of blades of the vanes collectively and cooperatively disposed to interact with the air within the chamber. Such interaction between the blades and/or other components of the resistance device/fan will result in a resistance to the rotation of the resistance device and thereby provide resistance to a user, causing the resistance device/fan to rotate.

Interaction between a user and forced movement of the resistance device is accomplished through the provision of a drive assembly connected in driving relation to the resistance device. Further, a handle, which effectively serves as a "paddle", is manipulated by the user to the extent of performing a plurality of different "rowing motions". As set forth above each rowing motion may be representative of a different "rowing routine". As also set forth above, each of a plurality of different rowing motions may duplicate or be substantially similar to the rowing motion of performed by an individual actually involved in kayaking, rowing, canoeing, etc.

The handle is connected in driving relation to the drive assembly by a connector structure. Accordingly, movement of the handle through anyone of a plurality of different rowing motions results in the connector structure driving the drive assembly, which in turn drives/rotates the resistance member within the air chamber. At least one operative and structural feature of the exercise assembly of the present invention includes the drive assembly including at least two drive sections. Each drive section is independently connected to the resistance device such that the resistance device may be independently driven/rotated by either of the two drive sections. Further, depending on the rowing motion applied to the handle by the user, the two drive sections may concurrently drive/rotate the resistance device. Also by way of example, when a user moves the handle in a rowing motion associated with kayaking, each of the drive sections will be alternately disposed in driving relation to the resistance device. In contrast, when a user moves the handle in a manner associated with conventional, two oar rowing, each of the two drive sections will be concurrently disposed in driving relation to the resistance device.

As generally set forth above, the exercise assembly of the present invention also includes a motion sensor mounted on or otherwise operatively associated with the handle. As such the motion sensor will detect and process each "rowing motion" of the handle, as performed by a user, such as through the operative features of an accelerometer, gyroscope or other motion analyzer/detector. Further, the motion sensor will generate or establish a set of "motion data" which distinguishes each of a plurality of different rowing motions from one another. Such motion data will then be transmitted to a display assembly, which includes a processor and possibly a software application facilitating the processing of the received motion data and the conversion thereof into digital display signals. The display signals may be further processed and as a result may be visualized in the form of a replication of a user, actual paddle, watercraft, etc. performing the "real life" rowing motion, which the user of the exercise assembly is attempting to perform using the handle of the exercise assembly. Any of a plurality of mobile or fixed processor/display devices may be used to view the generated display.

In addition to the above, the exercise assembly of the present invention may be operatively associated with and used in combination with a user support. As such, the user support is disposed and structured to facilitate a user being operatively disposed relative to a remainder of the exercise assembly in one or more preferred orientations. As used herein, the operative disposition of a user, when in one or more preferred orientations, facilitates intended and/or predetermined manipulation of the handle, so as to concurrently and/or alternatively operate the at least two drive sections of the drive assembly. As a result, the different rowing routines are accomplished by the user manipulating the handle in a manner which substantially simulates different rowing motions or related exercise motions.

Accordingly, one preferred embodiment of the user support is disposed and structured to operatively dispose the user relative to the housing of the exercise assembly concurrently to maintaining at least a majority of the user's body in a vertical, upright orientation. As used herein, a vertical, upright orientation of at least a "majority" of the user's body is meant to describe the user being supported primarily on the user support by his/her knees. Therefore, the "majority" of the user's body may be defined by the length of the user's body extending from the knees all the way up through the head. When so vertically oriented, the user may then be able to manipulate the handle through a number of different rowing routines including, but not limited to, the user standing on manually propelling a "paddle board". In the alternative, the at least partial vertical, upright orientation of the user, being supported on his/her knees may also resemble the motion of performed by an individual when propelling a kayak or similar watercraft.

In more specific terms, this embodiment of the user support includes a knee pad which may be formed of a relatively soft and or cushion-like material. The knee pad is dimensioned to support both knees of the user in a manner which enables the aforementioned vertical, upright orientation, while concurrently manipulating the handle. In addition, this embodiment of the user support is removably connected or attached to the housing of the exercise assembly thereby facilitating its operative position a predetermined spaced distance from the housing. In turn, the predetermined spaced distance will facilitate manipulation of the handle in a manner which simulates one or more of the aforementioned rowing routines.

Yet another embodiment of the user support comprises a seat assembly which facilitates the user being in a seated orientation while being operatively disposed a spaced distance from the housing. As indicated above, the spaced distance of the seat assembly from the housing will facilitate manipulation of the handle through one or more of predetermined or preferred rowing routines.

The seat assembly includes a seat section having a base which includes an outer surface having a curved configuration. When used by itself, the seat section movably supports a user in the aforementioned seated orientation, on a supporting surface. In more specific terms, when used individually, the seat section includes the outer surface of the base having a curved and preferably convex configuration. The curved and/or convex outer surface is disposed in movable engagement with the supporting surface, concurrent to the user being in a seated orientation thereon. Because of the curved outer surface, the seat section will have a tendency to reciprocally rotate, tilt, or move through a "rocking" motion, while manipulating the handle through a chosen rowing motion or exercise motion.

Therefore, the continuous reciprocal, tilting or rocking-like motion of the seat section, while manipulating the handle, forces the user to stabilize the seat section in a substantially "level" orientation. This in turn will require the user to utilize, exercise and therefore develop his/her core muscle grouping. Continued or repeated use will result in enhanced muscle development and overall health benefits to the user.

The versatility of the seat assembly of the user support is further demonstrated by the seat assembly including a retaining section. The retaining section may be disposed in a fixed, but removable, operative disposition in spaced relation to the housing. Moreover, the retaining section includes a receiving surface disposed in retaining fixed and removable engagement with the curved and/or convex outer surface of the base of the seat section. In addition, the receiving surface is cooperatively, but substantially oppositely, configured to the curved/convex outer surface of the base. As such, the receiving surface may have a concave configuration dimensioned, disposed and configured to receive the curved outer surface in mating engagement therewith. Fixed retention of the seat section on or at least partially within the concave receiving surface of the retaining section maintains a stable, level, somewhat elevated operative disposition of the seat assembly, relative to the housing. As a result, the user will be able to maintain the seated orientation, concurrent to manipulation of the handle through various routine or exercise motions, while not requiring unusual use, exercise, tensioning, etc. of the aforementioned core muscle grouping to maintain stability.

Therefore, the exercise assembly of the present invention, including each of a possible plurality of different preferred embodiments, demonstrates a significant degree of versatility which allows users, independent of age or gender, to perform a variety of different exercises through the performance of different rowing motions or exercise motions, which preferably define, represent and/or simulate different "rowing routines".

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
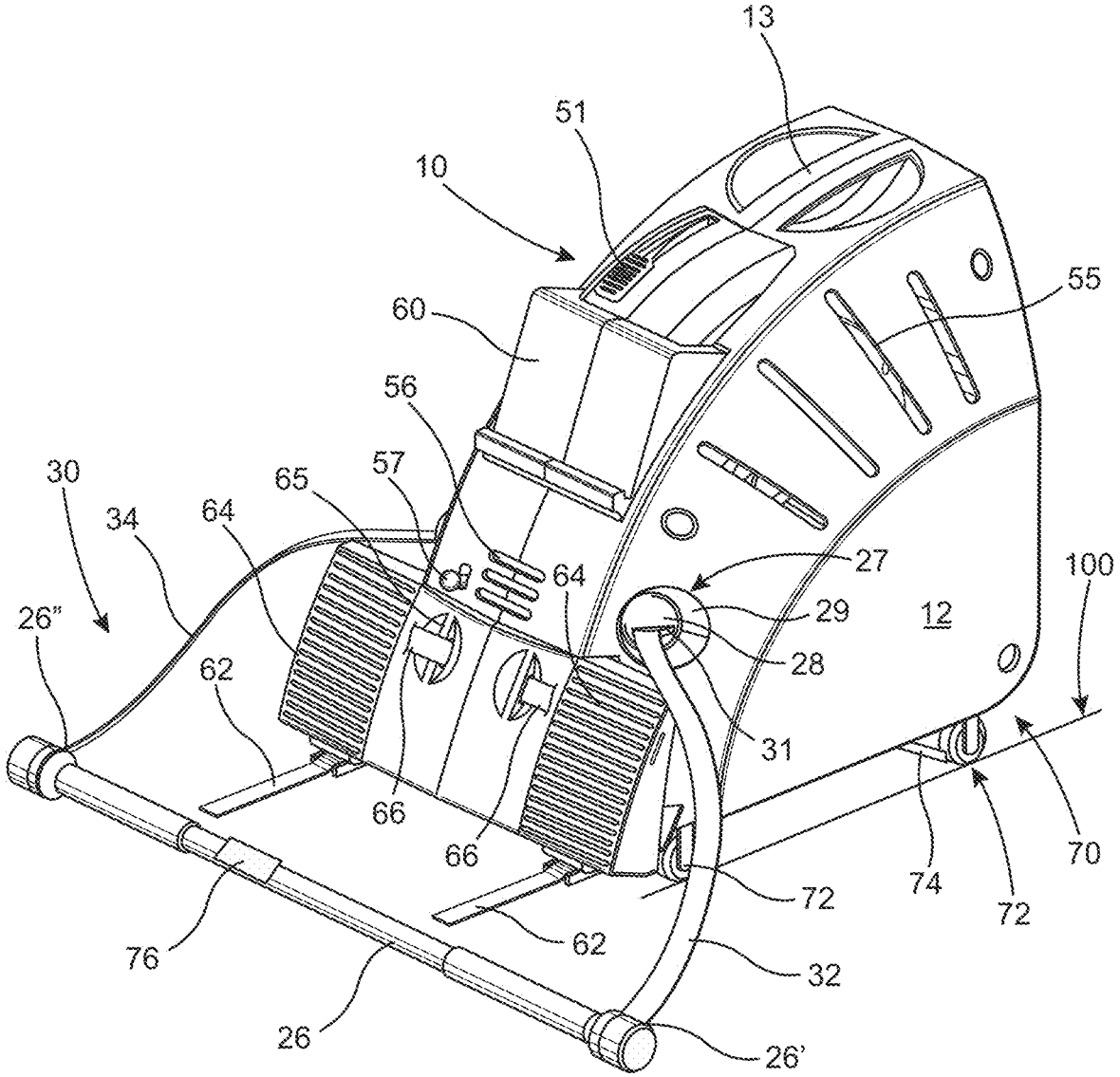
FIG. 1 is a perspective view of at least one preferred embodiment of the exercise assembly of the present invention.

As represented in the accompanying Figures, the present invention is directed to an exercise assembly generally indicated as 10 including a housing 12 disposed in enclosing relation to a chamber generally indicated as 14. The chamber 14, as explained in greater detail with reference to FIGS. 3 and 4, may be more accurately and definitively described as an air chamber through which air flows and in which air is at least partially or temporarily retained. In addition, the exercise assembly 10 of the present invention includes a resistance device, generally indicated as 16, which is preferably in the form of fan or fan-like structure having a plurality of blades 18. The blades 18 are preferably, but not necessarily, disposed about an interior periphery of the resistance device/fan structure 16.

The resistance device 16 is rotationally driven within the interior 14' of the air chamber 14 through activation of a drive assembly generally indicated as 20. The drive assembly 20 is represented in greater detail in FIG. 6 and includes at least two drive sections 22 and 24 each structured to independently and concurrently drive/rotate the resistance device/fan 16. Further, driving activation of the drive assembly 20 is accomplished by movement of a handle 26 through a variety of different "rowing motions" by a user (not fully represented in the accompanying Figures for purposes of clarity). Movement of the handle 26 through a variety of possible, different rowing motions results in driving of the drive assembly 20 including the alternate and/or concurrent driving of each of the driving sections 22 and 24. As such, the handle 26 is connected in driving relation to the drive assembly 20 by a connector structure 30, preferably including two connector members 32 and 34. As should be noted, each of the connector members 32 and 34 pass through the interior of the housing 12, through a ball joint mounting 27, which includes a ball 28, having an opening 31, and being movably disposed within a cavity 29. Further, each of the connector members 32 and 34 is attached to a different one of the drive sections 22 and 24.

In more specific terms, each of the connector members 32 and 34 enter the body 12 through correspondingly disposed ones of the openings or apertures 31 formed in correspondingly positioned ones of the spherical balls 28 of the different ball joint mountings 27. In addition, each of the balls 28 are made of a low-friction material movably disposed through an at least partially universal range of motion within corresponding ones of the cavities 29. The dimension and/or length or other cross-sectional dimension of each of the openings 31 is slightly larger than the corresponding transverse dimension or cross-section of the connector members 32 and 34. This allows each of the connector members 32 and 34 to pass through the opening 31, wherein the ball 28 is loosely disposed and movable within the low friction cavity. This enables the ball 28 to slide within the cavity and rotate in at least three dimensions.

Also, the opposite or outer, exposed portions of the connector members 32 and 34 are connected to the handle 26 in spaced relation to one another such as at, but not limited to, the opposite distal or free ends 26', and 26". By virtue of spaced apart connection of the connector members 32 and 34 to the handle 26, the different rowing motions capable of being performed by a user more closely represent the actual, real-life rowing motion associated with kayaking, conventional rowing, canoeing, etc.

Figure 6:
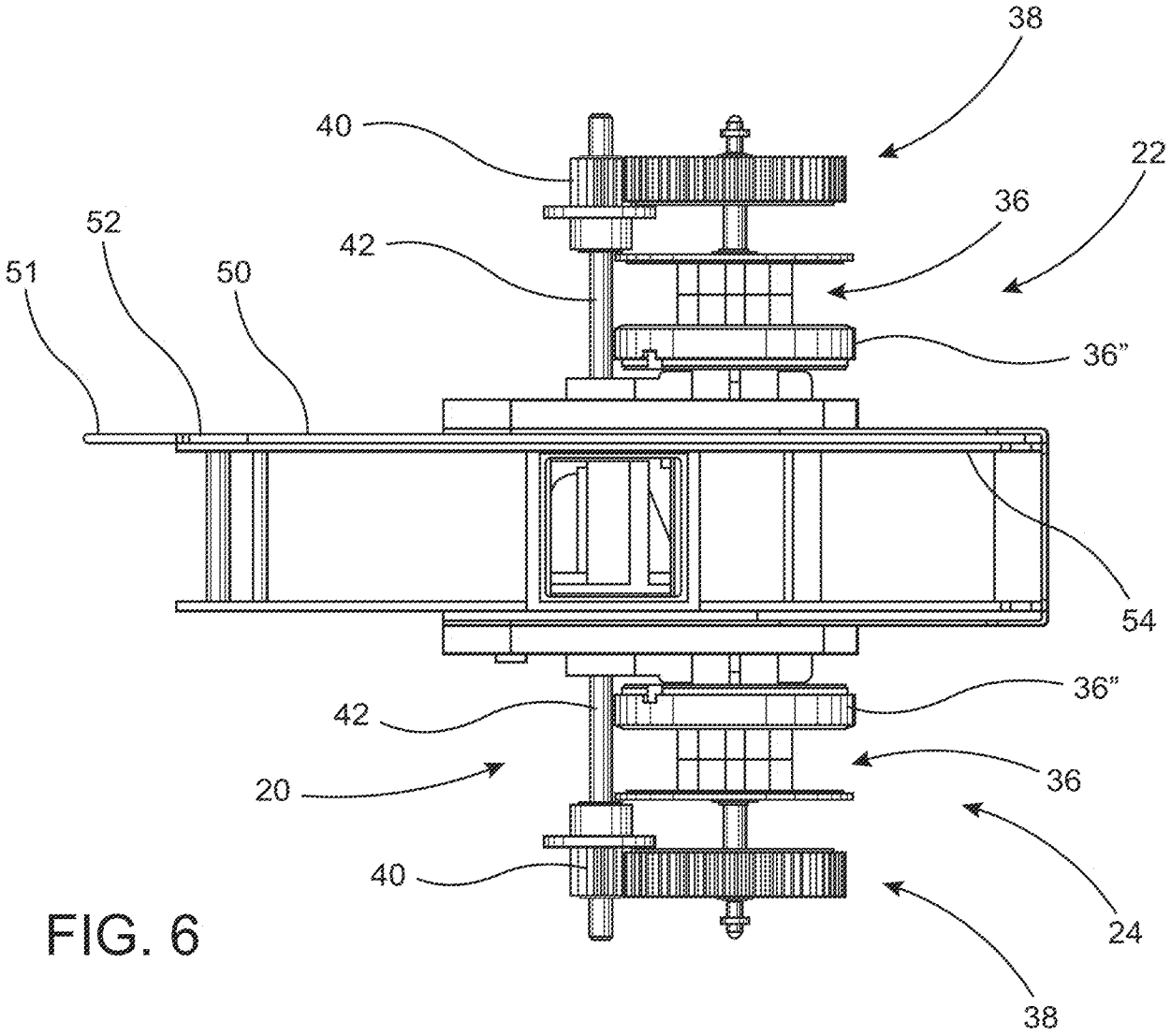
FIG. 6 is a top view of the interior structure and components primarily of the embodiment of FIGS. 3 and 4.

With primary reference to FIG. 6, at least one preferred embodiment of the drive assembly 20 includes the at least two drive sections 22 and 24, as set forth above. Further, each drive section 22 and 24 includes a pulley 36 connected to a correspondingly positioned, different one of the connector members 32 and 34. As such, the exertion of a pulling force on the handle 26 results in the connector members 32 and 34 exerting a concurrent or alternate pulling force on the respective pulleys 36. Such a pulling force in turn results in the rotation of the corresponding pulleys 36. Each pulley 36 is connected to and forces rotation of a different driving gear 38. As such the rotation of the respective pulleys 36 in turn causes a rotation of respective ones of the driving gears 38.

As also represented in detail in FIG. 6, each of the driving gears 38 are connected in intermeshing, driving engagement with a driven gear 40. Moreover, each of the driven gears 40 are connected to and rotational with a different drive axle 42. In addition, each drive axle 42 is independently connected to and/or disposed in driving engagement with the resistance device/fan structure 16, through appropriate linkage. Further, such appropriate linkage is operative to independently and/or concurrently dispose the different drive axles 42 in driving in relation to the resistance device/fan structure 16 and may include a clutch and/or "freewheeling" structure. Such clutch/freewheeling structure allows the resistance device/fan structure 16 to continue to rotate in an intended direction, concurrently to a retraction or rewinding of the connector members 32 and 34 on respective/corresponding ones of the pulleys 36.

Figure 8:
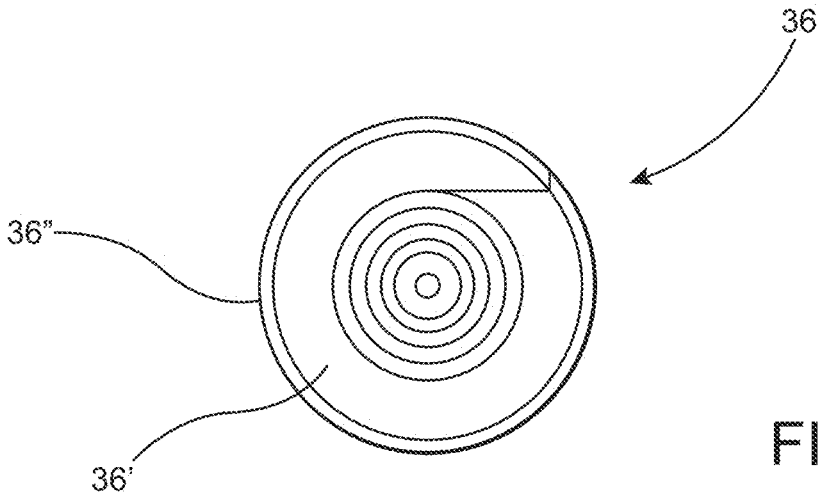
FIG. 8 is a detailed interior schematic view of operative components of the embodiment of FIGS. 1-6.

As represented in FIG. 8, each of the pulleys 36 may include a biasing member of a coiled spring 36' disposed on an interior of a casing 36". The biasing member 36' is disposed and structured to facilitate the respective pulley 36 being "rewound" by rotating in an opposite direction, once a pulling force, exerted thereon by corresponding ones of the connector members 32 and 34, is no longer being applied thereto. Such rewinding of the pulley members 36 will result in a rewinding of corresponding connector members 32 and 34 back onto the corresponding pulley 36, so as to be operationally positioned to exert the next pulling force on the corresponding pulleys 36.

Further, such a biasing member 36' may be in the form of a coil spring, inherently or normally biased into a coiled orientation, which facilitates a reverse rotation of the corresponding ones of the pulleys 36 once a pulling force is no longer exerted thereon by the handle 26 and a corresponding one of the connector members 32 and 34. Once rewound into the normally coiled orientation, each pulley 36 will thereby be in a position to again exert a driving, rotational force on corresponding ones of the drive gears 38 concurrent to corresponding ones of the connector members 32 and 34 exerting a pulling force thereon through movement/pulling/manipulation of the handle 26 by a user. In addition, each of the pulley members 36 may also be connected to corresponding ones of the drive gears 38 by an appropriate clutch mechanism and/or freewheeling drive structure. As a result, a reversed, rewinding rotation of each of the pulleys 36 is permitted without causing a concurrent reversed rotation of the drive gears 38. However, such a clutch mechanism/freewheeling structure may be associated directly with the drive axles 42. In such an embodiment, each of the drive gears 38 would rotate in a reverse orientation upon a rewinding of the pulley 36 and in turn cause the driven gears 40 and corresponding drive axles 42 to freely rotate without driving or interfering with the intended direction of rotation of the air cylinder 14.

As set forth above and otherwise herein, resistance to movement and/or rotation of the resistance device/fan structure 16 within the interior 14' of the air chamber 14 is a result of resistive, interaction of the plurality of fan blades 18 with air within the interior 14'. Such resistance to rotation of the resistance device 16 within the chamber interior 14' may be at least partially dependent on the quantity and/or flow of air within and through the air chamber 14.

Figure 3:
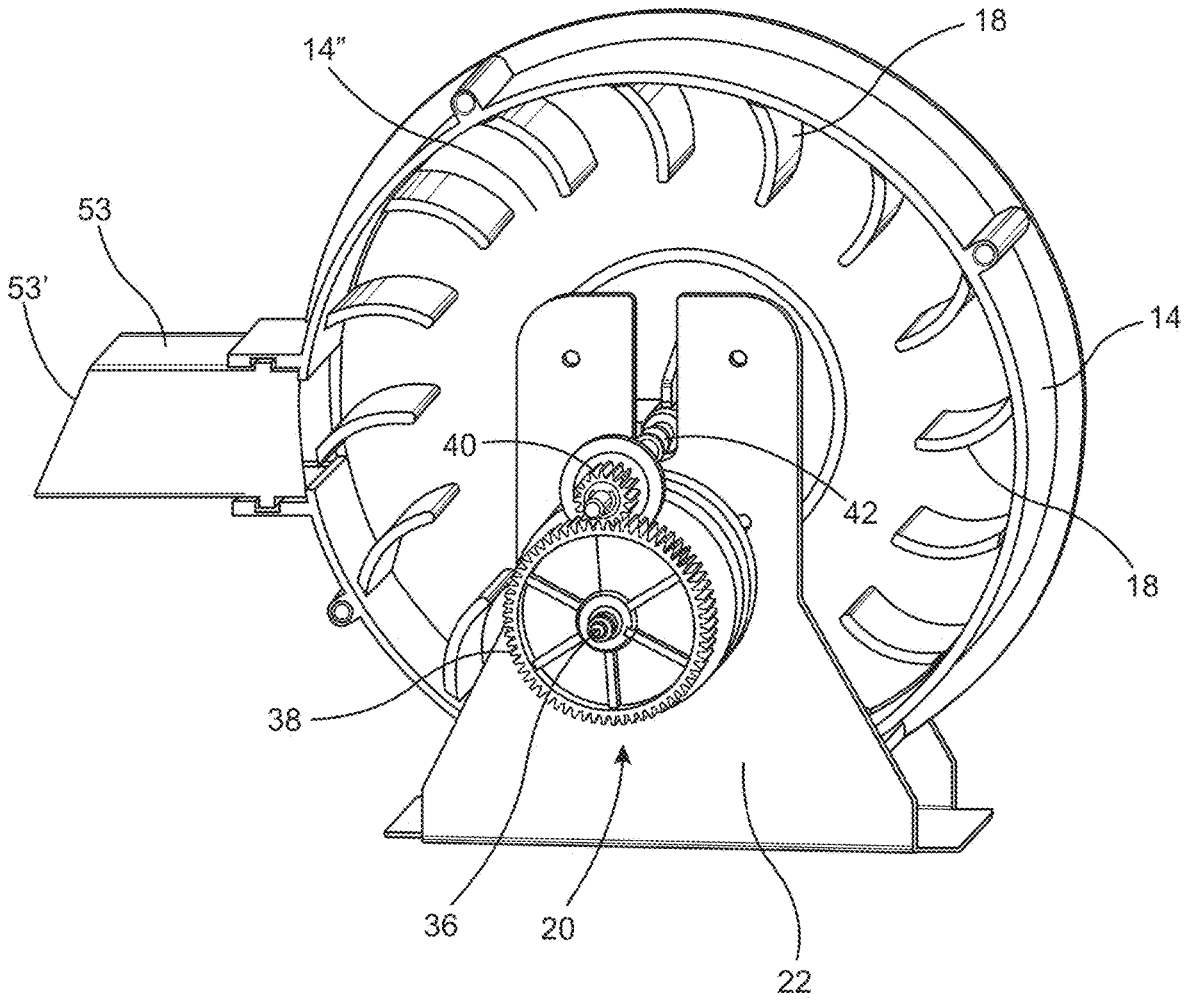
FIG. 3 is a perspective, interior detail view of the embodiment of FIG. 3.
Figure 4:
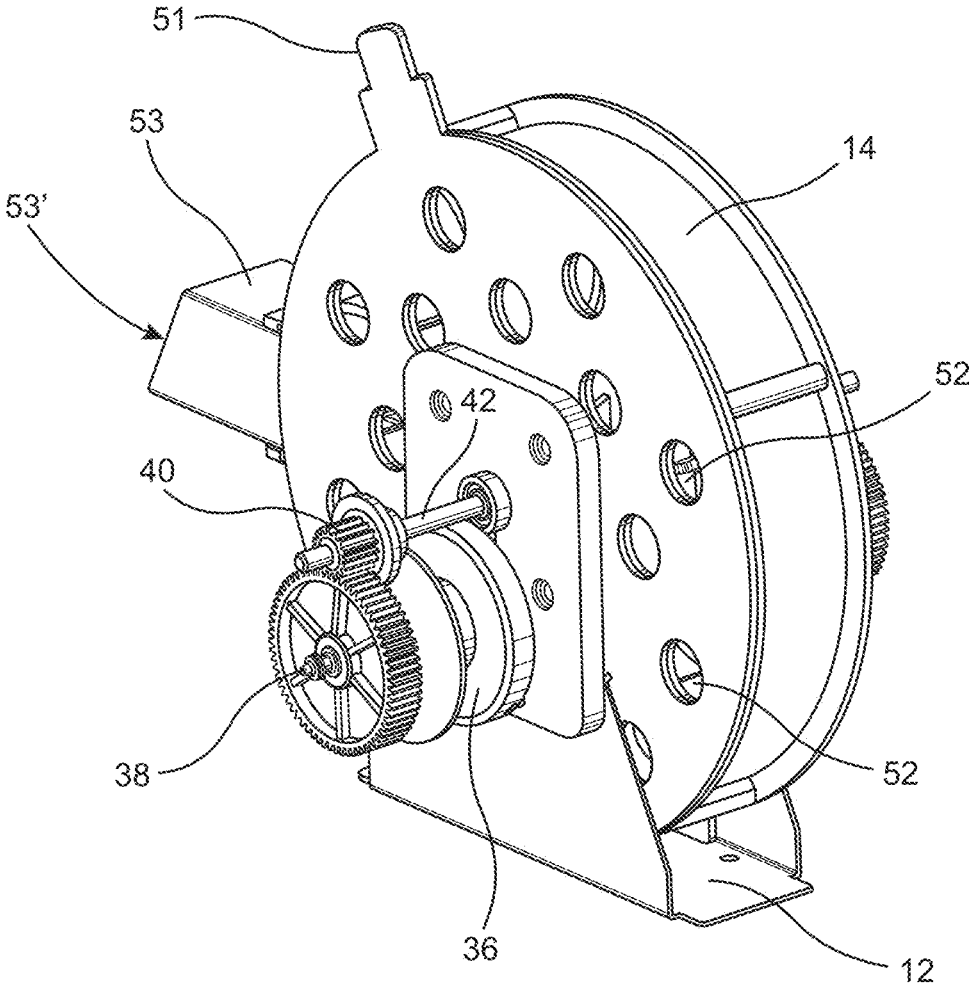
FIG. 4 is a perspective view of the interior, operative components of the embodiments of FIGS. 1-3.
Figure 5:
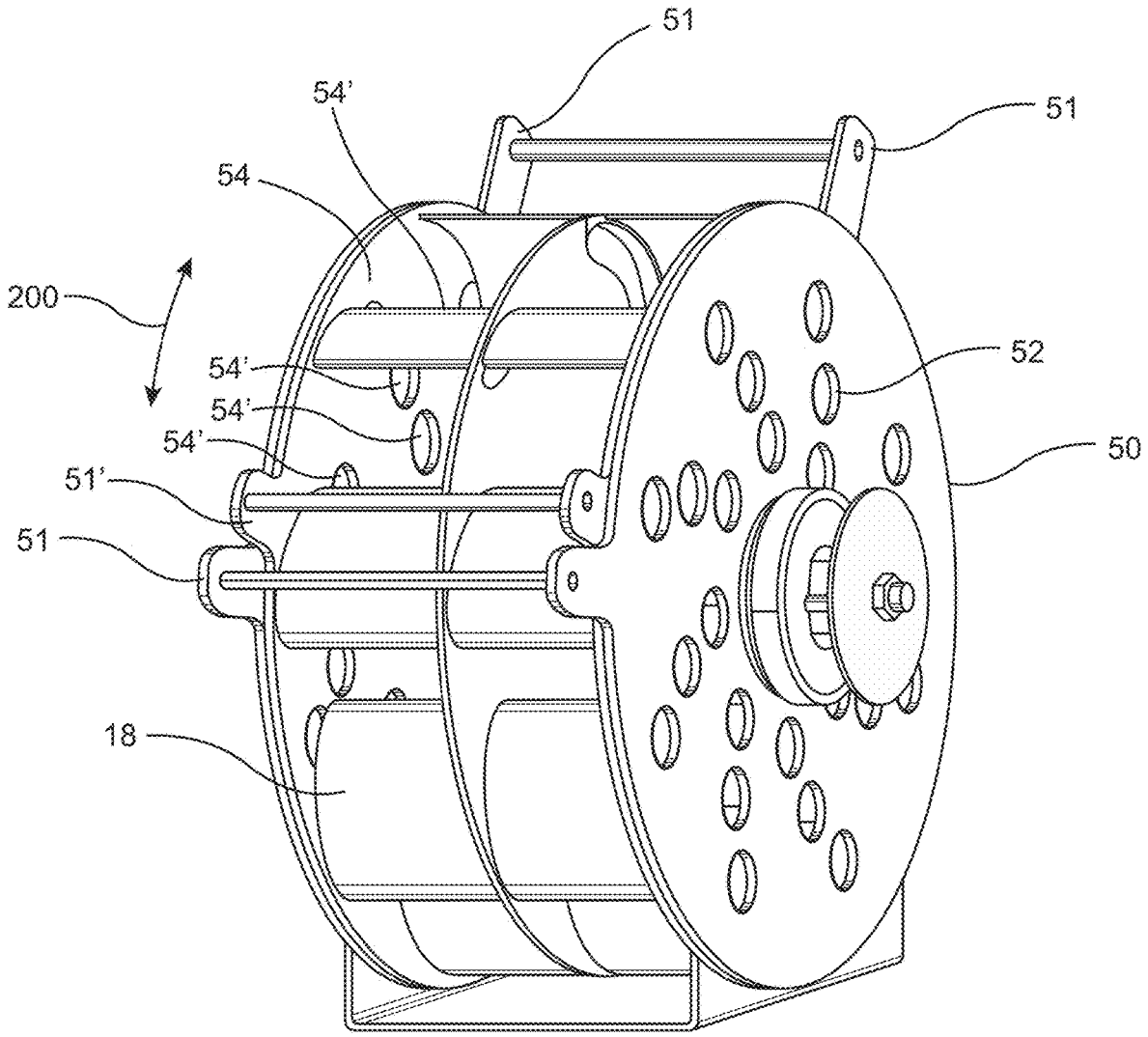
FIG. 5 is a detailed view in perspective of the structural components represented in FIGS. 3 and 4.

Accordingly and with primary reference to FIGS. 3-5, the exercise assembly 10 of the present invention includes an air intake generally indicated as 50. The air intake 50 may include a rotationally mounted plate or like structure having an apertured configuration including at least one, but more practically, a plurality of apertures 52. Further, the air chamber 14 preferably includes dual air inlets 54, which may be defined by spaced apart interior walls or sides of the air chamber 14. Each of the air inlets 54 also includes at least one or a plurality of openings or apertures 54'. The air intake 50 and apertures 52 are movable relative to the dual air inlets 54 and apertures 54', by manipulation of the knob or like structure 51, to accomplish rotational or other appropriate movement of the air intake 50, as schematically indicated by directional arrow 200. Similarly, each of the air inlets 54 and corresponding apertures 54' is movable relative to the air intake and apertures 52 by manipulation of knob or like structure 51', also schematically represented by directional arrow 200. Such adjustment or movement of the air intake 50 and/or the air inlets 54 results in an alignment or misalignment of the corresponding apertures 52 in the air intake 50 and the apertures 54' in each of the dual air inlets 54. As should be apparent, an alignment of the apertures 52 and 54' will in turn result in a greater flow of air passing into and through the interior 14' of the air chamber 14 from an exterior thereof. In contrast, a purposeful misalignment of the apertures 52 and 54' will result in less air flowing into and out of the interior 14' of the air chamber 14.

Figure 2:
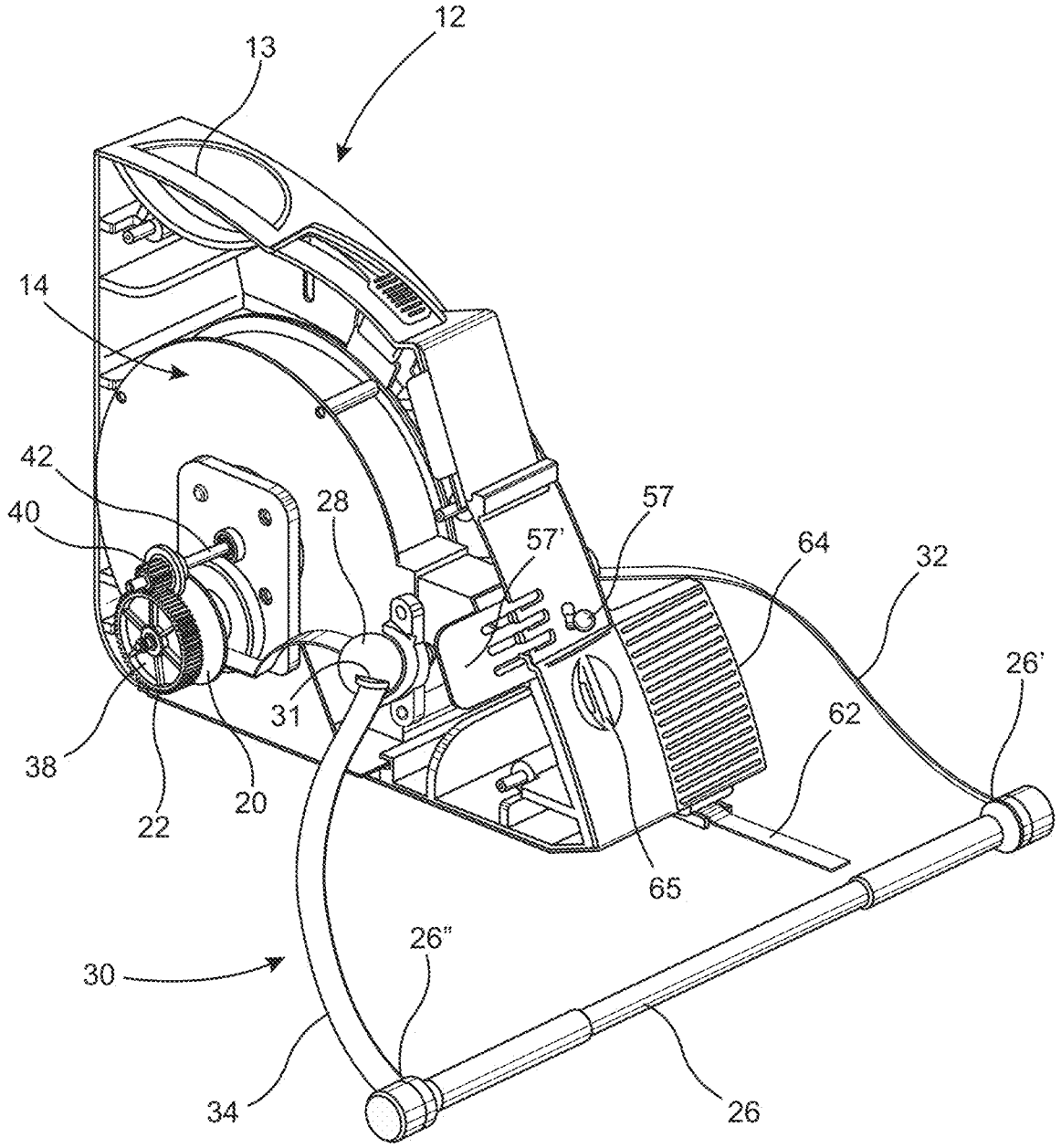
FIG. 2 is a perspective view in partial cutaway representing both exterior and interior portions of the embodiment of FIG. 1.

The air at least partially and temporarily retained within the interior 14' of the air chamber 14 is also regulated through the provision of an exhaust or exit 53 having an open end 53' through which air exits from the chamber interior 14'. Further, as represented in FIGS. 1 and 2 the housing 12 includes a plurality of vents 55 and 56 which are respectively disposed and structured to allow the intake and exiting of air there through. As such, air may pass into the interior 14' of the air chamber 14 through vents 55 and exit the interior 14' through the open and 53' of the exhaust 53 and also through the exhaust vents 56. As also represented in FIGS. 1 and 2, the amount of air exiting the air chamber interior 14' through the exhaust vents 56 and aligned opening 53' of the air exhaust 53 may be regulated to the extent of being at least partially opened or closed. Such regulation may occur by manipulation of a knob or like structure 57 which controls the positioning of an exhaust regulator structure 57' disposed and structured to at least partially enclosed within its 56.

As such, a closing of the vents 56 will result in more air being retained within the interior 14'. In contrast an opening of the vents 56 will result in a free flow of air through the interior 14', assuming that the corresponding openings or apertures 52 and 54' of the air intake 50 and air inlet 54 are at least partially aligned.

Yet additional structural features associated with one or more preferred embodiments of the exercise assembly 10 include the housing 12 having a handle 13 facilitating the lifting and or otherwise positioning of the housing 12 in a variety of different locations. The housing 12 also includes a support area or platform 60 mounted on an exterior portion thereof and being dimensioned and structured to support or be structurally associated with a display assembly, generally indicated as 80, to be described in greater detail with specific reference to FIG. 7. Also, the housing 12 may include rigid or non-rigid straps, arms, runners or like structures 62 serving to interconnect the housing 12 with an appropriate seat or other user support structure for operative and proper positioning of a user relative to the housing 12, handle 26 and connector structure 30.

When so positioned, at least one embodiment of the housing 12 also includes a retaining assembly including foot or engagement pads 64 for placement of a user's foot or other appropriate portion of the user body. Also, the retaining assembly may include retaining members 66 such as one or more straps, belts or other appropriate retaining members. When in use, the retaining members 66 engage the user's feet in a manner which allows the user to move relative to the housing 12 during the performance of certain one or more rowing motions. In addition the retaining member 66 are structured to allow movement of the housing with and relative to the user when he is attached to the retaining members 66, such as being engagement with the engagement pads 64.

In more specific terms, the housing 12 includes a movable support generally indicated as 70, which may be in the form of one or more rollers, castors, or like movable support members 72 serving to support the housing 12 on a supporting surface 100. Further, the movable support 70 and each of the one or more movable support members 72 may be operatively associated with a locking structure or assembly 74. The locking assembly 74 may be selectively disposed between a "locked" and "unlocked" position relative to the movable support members 72. When in the locked orientation the housing 12 is fixed relative to the supporting surface 100 and relative to the operative position of a user, when in use. As a result, the user may move relative to the housing 12 when performing the various rowing motions, such as a rowing motion associated with kayaking.

In contrast, when the one or more locking members 74 are disposed in an unlocked orientation relative to the movable support member 72, the housing 12 may move over the supporting surface 100. Therefore, when the user performs any one of a plurality of different rowing motions, the housing 12 and the user may move relative to one another. Such relative movement is facilitated by the retaining straps or like member 66 engaging the feet or other portion of the user. For example, the extension and retraction of a user's legs will result in the movement of the user relative to the housing 12 and in certain instances the concurrent movement of the housing 12 and user, relative to one another, such as when performing a conventional two "oar" rowing motion.

In addition to the above, the exercise assembly 10 of the present invention may be operatively associated with and used in combination with one or more users supports. As such, each of a possible plurality of user supports are disposed and structured to facilitate a user being operatively disposed relative to a remainder of the exercise assembly 10 and/or housing 12 in one or more preferred orientations. As used herein, the operative disposition of a user, when in one or more preferred orientations, facilitates intended and/or predetermined manipulation of the paddle/handle 26, so as to concurrently and/or alternatively operate the at least two drive sections 22 and 24 of the drive assembly 20. As a result, the different rowing routines are accomplished by the user manipulating the handle 26 in a manner which substantially simulates different rowing motions or related exercise motions.

Figure 9:
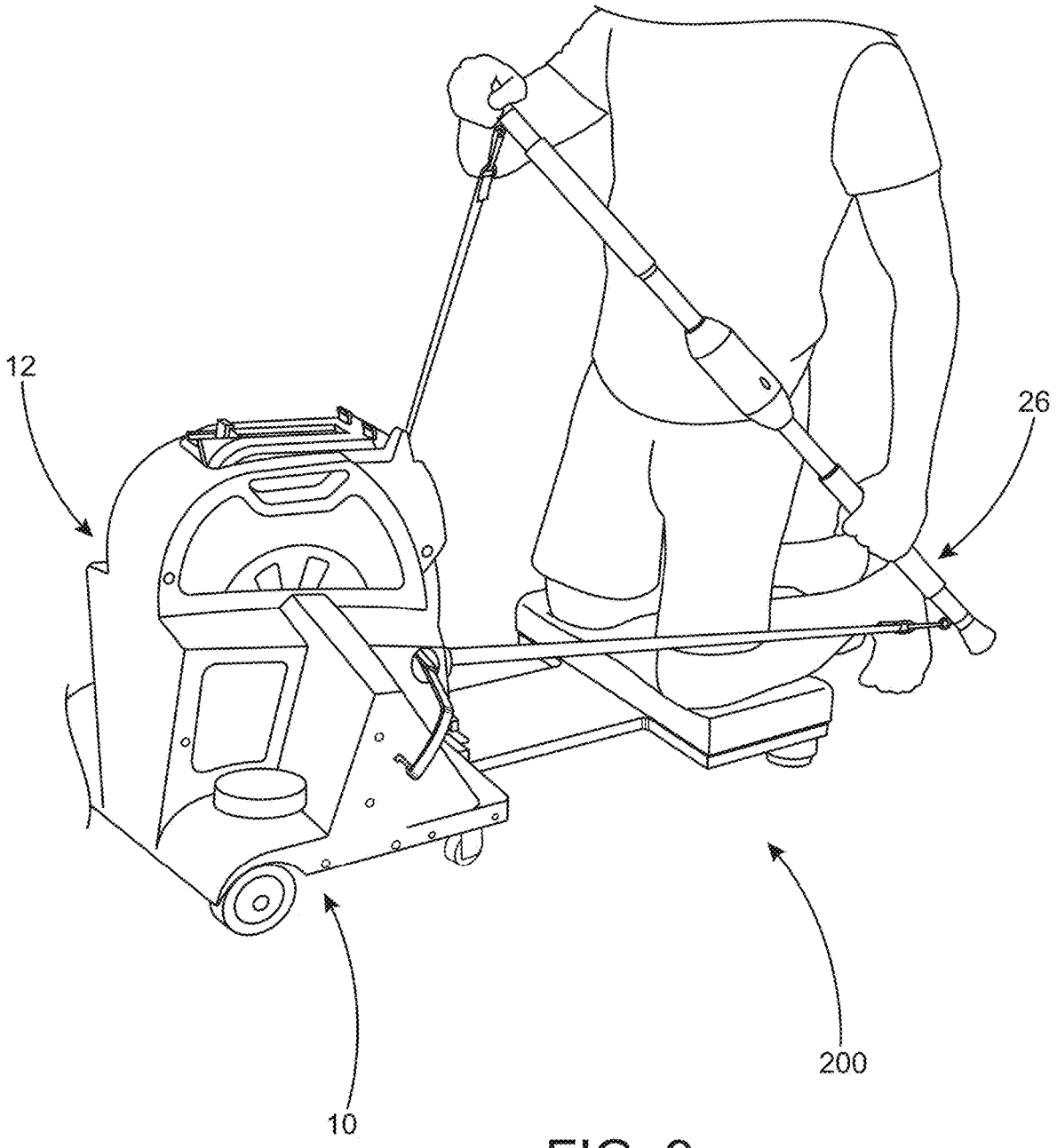
FIG. 9 is a perspective view of one embodiment of a user support assembly which may be operatively associated with the exercise assembly of the embodiments of FIGS. 1-8.
Figure 10:
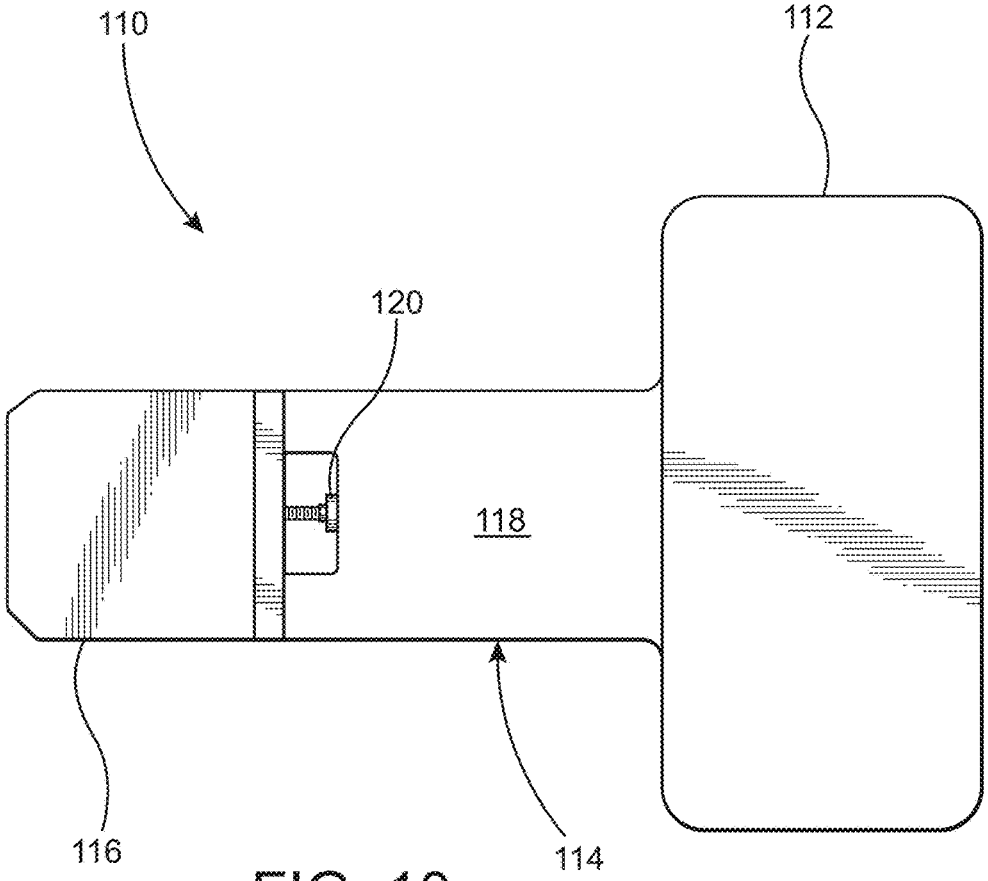
FIG. 10 is a top plan view of the user support assembly of the embodiment of FIG. 9.

With initial and primary reference to FIGS. 9 and 10, one preferred embodiment of the user support is generally represented as 110 and is disposed and structured to operatively dispose the user relative to the housing 12 of the exercise assembly 10. As clearly represented in FIG. 9, the user support 110 is disposed and structured to concurrently maintain at least a majority of the user's body in a vertical, upright orientation. As used herein, a vertical, upright orientation of at least a "majority" of the user's body is meant to describe the user as substantially represented in FIG. 9. More specifically, in such an orientation the user is supported by his/her knees. Therefore, as represented in FIG. 9, the "majority" of the user's body may be defined by the length of the user's body extending from the knees upwardly to and including the head. When in such a vertical, upright orientation, the user may then be able to manipulate the handle 26 through a number of different rowing routines of the type, but not limited to, the user standing on manually propelling a "paddle board". In the alternative, the at least partial vertical, upright orientation of the user being supported on his/her knees, may also resemble the paddling or rowing motion performed by an individual when propelling a kayak or similar watercraft.

In more specific terms, the user support 110 includes a knee pad 112 which may be formed of a relatively soft and or cushion-like material. The knee pad 112 is dimensioned to support both knees of the user in a manner which enables the aforementioned majority of the user's body being in a vertical, upright orientation, while concurrently manipulating the handle 26. In addition, this embodiment of the user support 110 is removably connected or attached to the housing 12 of the exercise assembly thereby facilitating its operative positioning a predetermined spaced distance from the housing 12. Such a predetermined spaced distance facilitates or assures access to and manipulation of the handle 26 by a user.

The user support 110 includes an attachment structure 114 having an outer or distal attachment end 116 dimensioned, disposed and structured for engagement/attachment to the front or operative area of the housing 12, as represented in FIG. 9. Moreover, the distal attachment end 116 may be removably secured to the housing 12 by any one of a plurality of appropriate attachment assemblies generally indicated as 120. Further, the attachment structure 114 includes an intermediate and/or interconnecting portion 118 serving to removably but fixedly connect the knee pad 112 to the housing 12 via the distal attachment end 116 in a predetermined or preferred spaced distance therefrom. The predetermined spaced distance will serve to position the user in a location which will facilitate manipulation of the handle 26 in a manner simulating one or more of the aforementioned rowing routines.

It is noted that the distal attachment end 116, as well as the interconnecting portion 118 of the user support 110 is represented as a solid, single piece construction. However, a structural variance of attaching the knee pad 112 to the housing 12 may be accomplished by rigid arms, runners or like structures 62, as described above, and clearly represented in FIG. 1.

Figure 11:
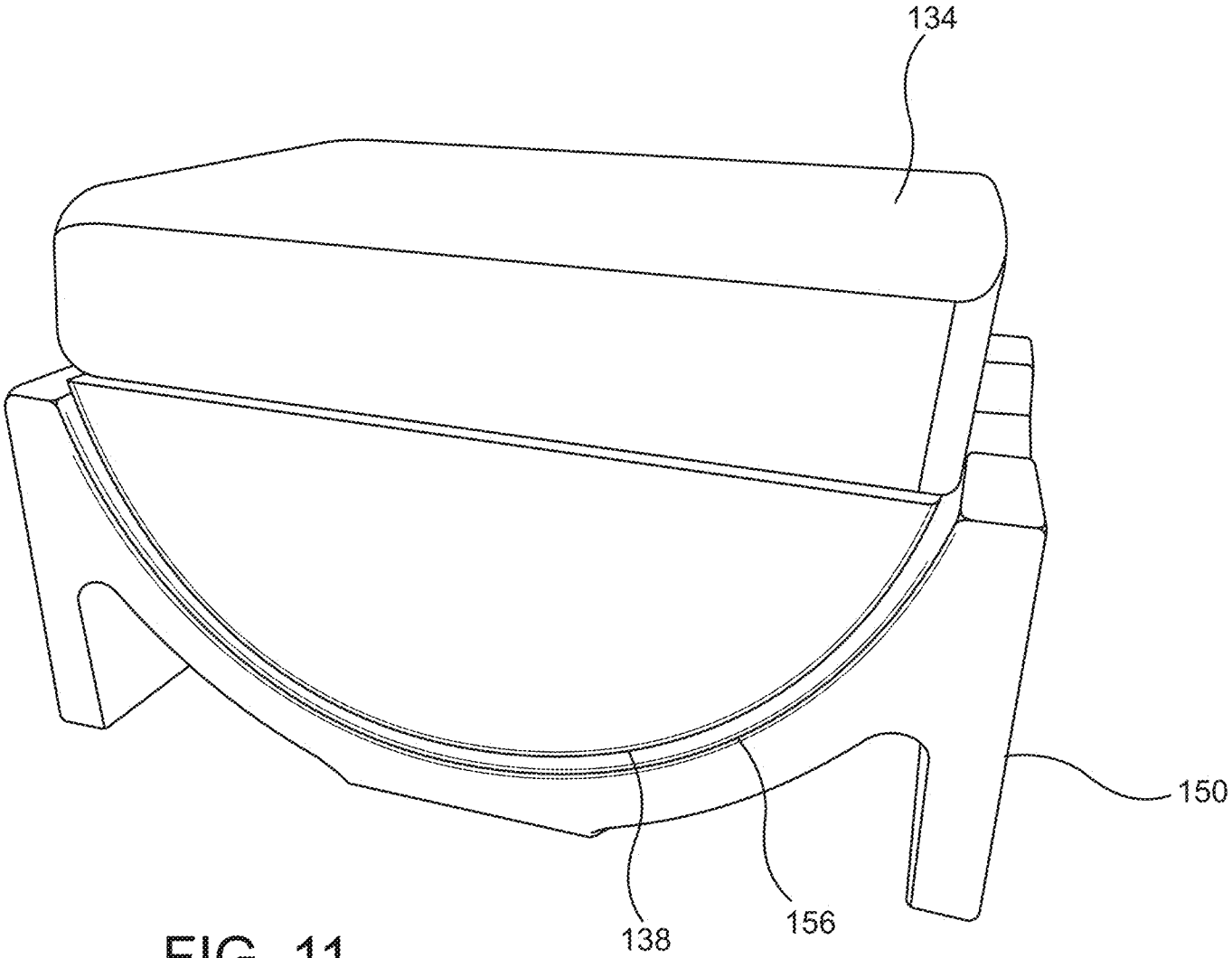
FIG. 11 is a perspective view of yet another embodiment of a user support assembly which may be operatively associated with the exercise assembly of the embodiments of FIGS. 1-8.
Figure 12B:
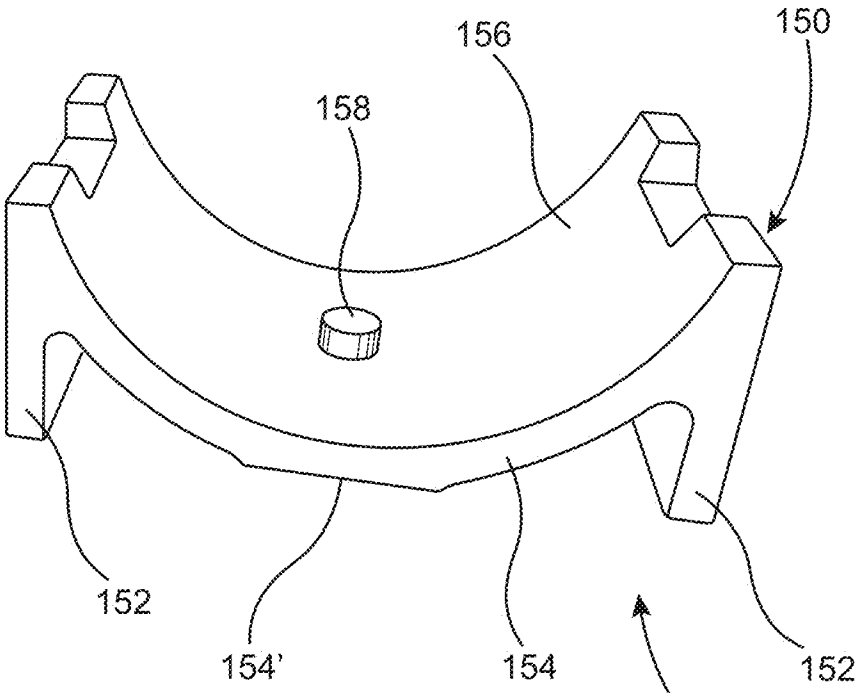
FIG. 12B is a perspective view of one additional component of the user support assembly of the embodiment of FIG. 11.
Figure 12A:
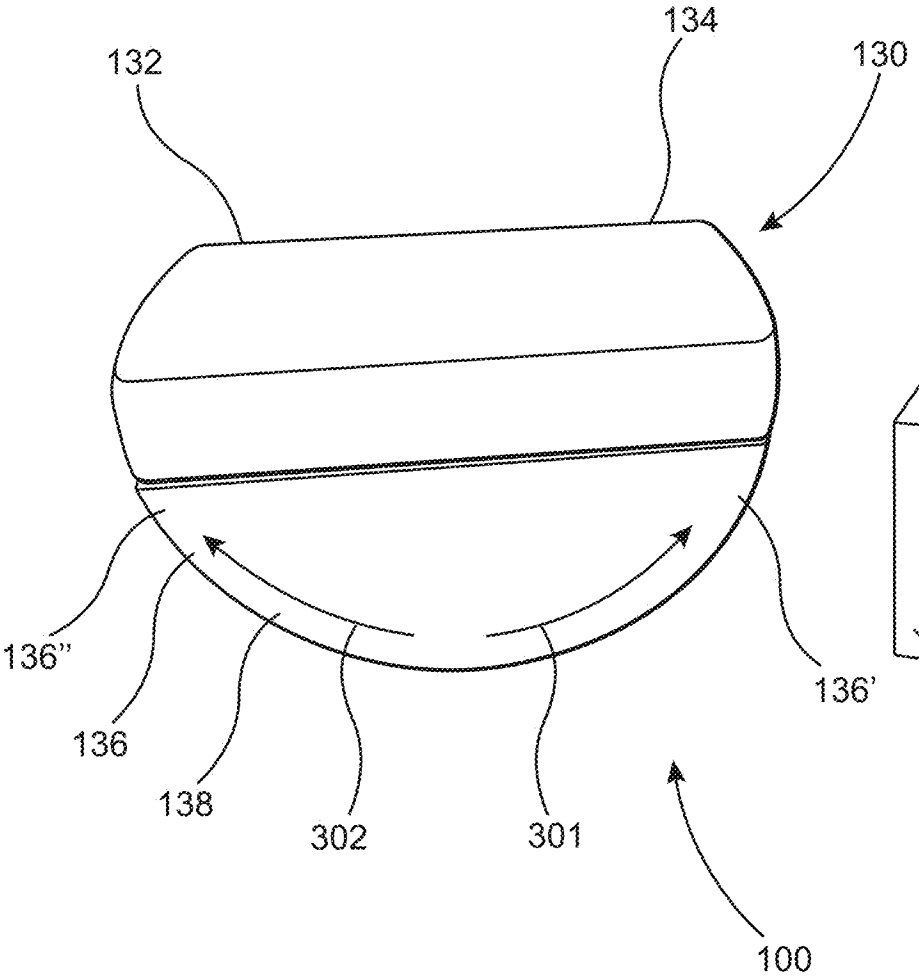
FIG. 12A is a perspective view of one component of the user support assembly of the embodiment of FIG. 11.

Yet another embodiment of the user support is represented in FIGS. 11, 12A and 12B and comprises a seat assembly 130. The seat assembly 130 facilitates support of the user in a seated orientation while being operatively disposed a spaced distance from the housing 12. As indicated above, the operative disposition and/or spaced distance of the user and seat assembly 130 from the housing 12 will facilitate access to and manipulation of the handle 26 through one or more of predetermined or preferred rowing routines.

The seat assembly 130 includes the seat section 132 including a cushion or other user supporting component 134 and a base 136. Further, the base 136 includes an outer surface 138 having a curved configuration, preferably but not necessarily, extending along at least a majority or the entirety of the curved length of the base 136, between opposite ends 136' and 136". When used by itself, the seat section 132 movably supports a user, in the aforementioned seated orientation, on a supporting surface 100. In more specific terms, when used individually, the seat section 132 includes the outer surface of the base 136 having a curved and preferably convex configuration disposed in movable engagement with the supporting surface 100, concurrent to the user being in a seated orientation thereon. Because of the curved/convex outer surface 138, the seat section 132 will have a tendency to reciprocally rotate, tilt, or move through a "rocking" motion, as schematically represented by directional arrows 301 and 302 in FIG. 12A. Therefore, concurrent to the user manipulating the handle 26 through one or more rowing or exercise motions, the base 136 will have a tendency to tilt, at least partially rotate and/or "rock" back and forth.

Therefore, the continuous reciprocal, tilting or rocking-like motion 301/302 of the seat section 132, while manipulating the handle, forces the user to stabilize the seat section 132 and base 136 into a substantially "level" or non-rocking orientation. Such stabilization will require the user to utilize, exercise and therefore develop his/her core muscle grouping. Continued or repeated use will result in enhanced muscle development, strength and overall health benefits to the user.

For purposes of clarity, the aforementioned reciprocal tilting or "rocking" motion may be at least partially defined by the base 136 having a tendency to tilt reciprocally (back and forth) in the direction of arrows 301 and 302. In more specific terms, when the base 136 tilts in the direction of the arrow 301 the end 136' of the base 136 will rise concurrently to the lowering of the end 136" of the base 136. Correspondingly, reciprocal tilting movement of the base 136, in the direction of arrow 302, comprises the end 136" of the base 136 rising concurrently to the end 136' moving lower, towards the supporting surface 100. As should be apparent, the user may operate more efficiently when the seat assembly 132 is "stabilized" by being disposed in a substantially level, non-rocking orientation, when seated. As indicated such stabilization may necessitate the utilization, tensioning, etc. of certain core muscle groupings of the user.

The versatility of the seat assembly 130 of the user support is further demonstrated by the inclusion of a retaining section 150 as individually represented in FIG. 12B. The retaining section 150 is structured to be disposed in a fixed, but removable, operative disposition on the support surface 100 in spaced relation to the housing 12. Moreover, the retaining section 150 includes spaced apart legs 152 fixedly but removably supporting an intermediate portion 154 on the supporting surface 100. As also represented in FIG. 12B, the intermediate portion 154 may also be in supported engagement on the surface 100, as at 154'.

The retaining section 150 also includes a receiving surface 156 disposed in fixed and removable retaining engagement with the curved and/or convex outer surface 138 of the base 136 of the seat section 132. In addition, the receiving surface 156 is cooperatively, but substantially oppositely, configured to the curved/convex outer surface 138 of the base 136. As such, the receiving surface 156 preferably includes a concave configuration dimensioned, disposed and configured to receive the curved outer surface 138 of the base 136 in mating engagement therewith. Fixed retention of the seat section 132 and base 136 on or at least partially within the concave receiving surface 156 of the retaining section 150 establishes and/or maintains a stable, level, somewhat elevated operative disposition of the seat assembly 130, relative to the housing 12. As a result, when the user is supported on the seat assembly 130, he/she will be able to maintain a seated orientation, concurrent to manipulation of the handle 26 through various routines or exercise motions, while not requiring unusual use, exercise, tensioning, etc. of the aforementioned core muscle grouping to maintain stability.

As represented in FIG. 12B, the retaining section 150 also includes a stabilizing member 158 which may extend outwardly from the concave receiving surface 156. As such, the stabilizing member 158 is disposed in cooperative mating or other appropriate engagement with a structure on the curved, convex outer face 138. When the stabilizing member 158 is so engaged with the base 136 and/or portion of the outer surface 138, the base 136 and the entire seat section 130 will be fixedly but removably disposed on the retaining section 150, within the curved/concave surface 156.

Figure 7:
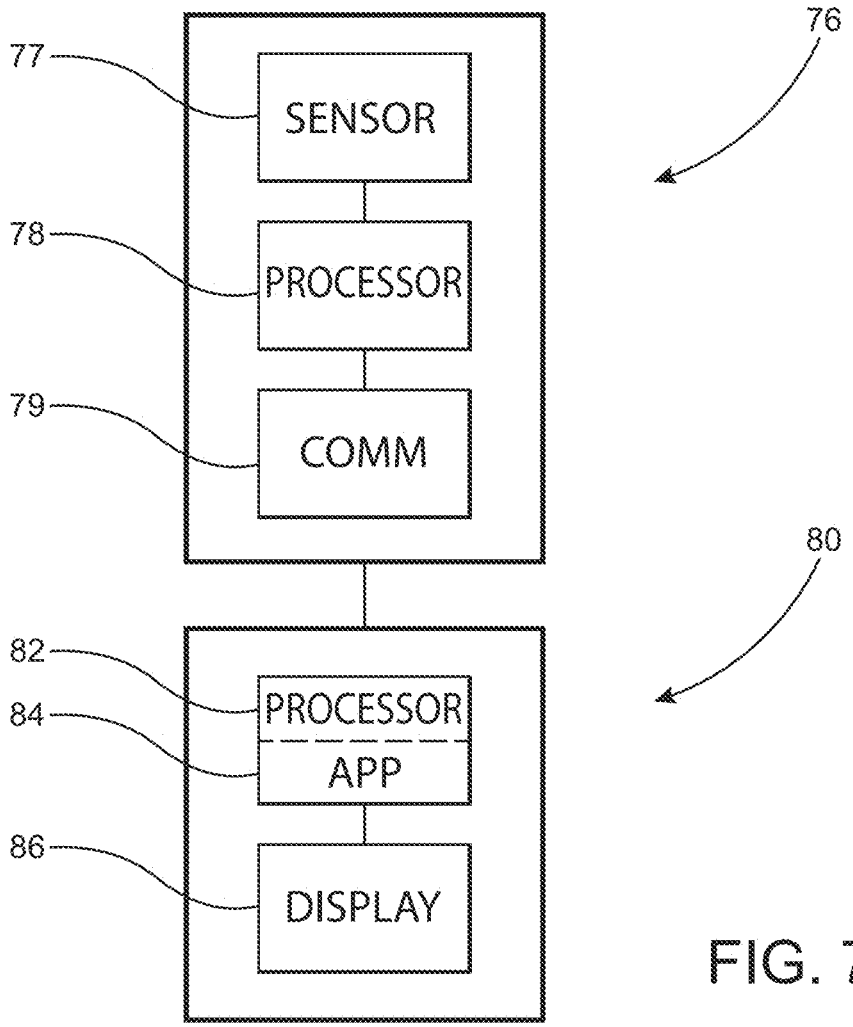
FIG. 7 is a schematic representation of a motion sensor assembly and operatively associated display assembly usable with the embodiments of at least FIGS. 1-6.

One or more preferred embodiments of the exercise assembly 10 of the present invention also includes a motion sensor assembly 76, as schematically represented in FIGS. 1 and 7. The motion sensor assembly 76 is connected to, mounted on or otherwise operatively associated with the handle 26. As such the motion sensor assembly 76 will include a sensor device which may have the operative capabilities of an accelerometer, gyroscope or other analyzer component 77 operative to detect and process, in cooperation with a processor 78 each "rowing motion" of the handle 26, as performed by a user. Further, the motion sensor assembly 76, through operative association with the analyzer 77 and processor 78, will generate or establish different "motion data" which distinguishes each of a plurality of different rowing motions from one another. Such motion data will then be transmitted, via a short range or other operable communication facility 79, to a display assembly 80.

The display assembly 80, including a processor 82 associated therewith, may also include a software application 84 facilitating the processing of the received motion data and the conversion thereof into display signals. In turn, the display signals may be transmitted to and visualized on a display device 86. The visual representation on the display device 86 may be in the form of a replication of a user, actual paddle, watercraft, etc. performing the "real life" rowing motion or movement which the user of the exercise assembly is attempting to perform using the handle 26 thereof. The visual representation on the display device 86 may be in the form of or incorporated within video games, videos, virtual reality videos and/or fitness tracking software, etc. Further, the display assembly may comprise or include smartphones, tablets, or virtual reality goggles with appropriate software 84, which translates and integrates the motion data into matching 3-dimensional paddle movement and projected 3-dimensional movement of a kayaker, rower and/or a kayak and/or rowing boat, displayed within video games, videos, virtual reality videos, and fitness tracking software.

Figure 13:
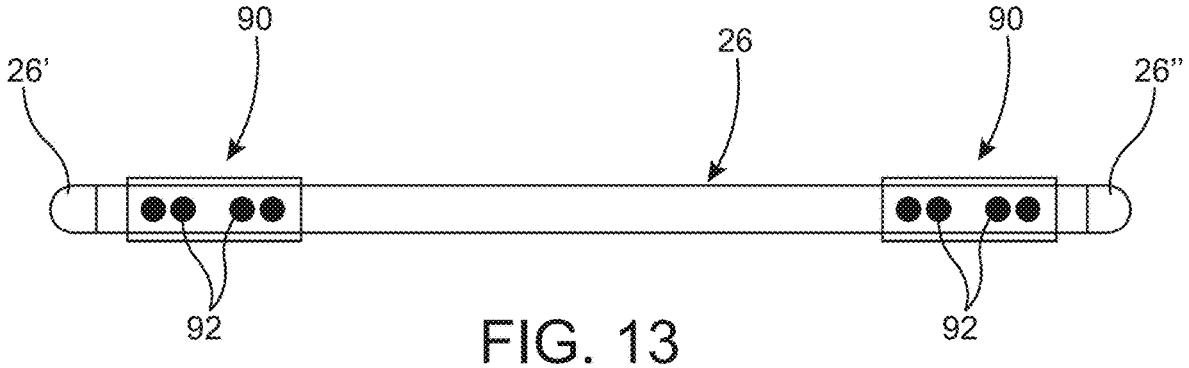
FIG. 13 is a schematic plan view of one embodiment of the handle of the exercise assembly of the present invention including a user interface connected thereto.

In addition, and as part of the embodiment represented in FIG. 7, a user interface, generally indicated as 90 in FIG. 13, is further integrated into the gaming, fitness, tracking, etc. features. Such user interface 90 may take the form of triggers, buttons, wheels or other manually operated input devices, generally indicated as 92, mounted on or connected to the paddle/handle 26, preferably adjacent one or both ends 26' and 26" thereof. Such input devices 92 receive input from a user's touch from the fingers, hands or the motion thereof, as the user grips the paddle/handle 26, adjacent one or both ends 26' and/or 26". Such user interface devices 92 may be integrated into the motion tracking capabilities, as outlined above. Further, the user interface devices 92 can be touched, pushed or otherwise manipulated by one or both hands of a user, which are typically positioned adjacent to the ends 26' and 26" during a selected rowing motion. Moreover, such manipulation of the user interface devices 92 will result in the generation of corresponding and possibly pre-programmed reactions and scenarios by the software associated with the embodiment of FIG. 7.

Further, an electronic potentiometer associated with the exercise assembly 10 is operative to detect a degree or amount of airflow within and/or through the air chamber 14. Detected air flow information is relayed wirelessly to the software/processor 78 and/or 82 of FIG. 7, which calculates a level of resistance provided by different levels of air flow through chamber 14 and the resistance assembly associated therewith. Also, the determined levels of resistance may be made visually observable to the user on the display 86.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An exercise assembly structured to perform different rowing routines, said exercise assembly comprising:

a housing including a chamber, a resistance device movably disposed within said chamber, said resistance device structured to resist predetermined movement of said resistance device within said chamber, a drive assembly comprising at least two drive sections each movably and independently connected in driving relation to said resistance device, a handle connected in driving relation to said drive assembly and concurrently movable with and relative to said drive assembly, through a plurality of different rowing motions, a user support disposed adjacent said housing and structured to support a user in an operative position relative to said housing concurrent to manipulation of said handle by the user, said user support comprising a seat section structured to support the user in a seated orientation and including a base, said base configured for movable support of the user on a supporting surface, said base including an outer surface having a convex configuration disposed in movable engagement with the supporting surface, concurrent to the seated orientation of the user, said user support further comprising a retaining section disposable in a removably fixed position on the supporting surface, concurrent to a fixed retaining engagement with said seat section, and said retaining section includes a receiving surface disposed in retaining engagement with said outer surface of said base.

2. The exercise assembly as recited in claim 1 wherein said user support is configured to support at least a majority of the user's body in a substantially vertical, upright orientation, concurrent to manipulation of said handle.

3. The exercise assembly as recited in claim 2 wherein said user support comprises a knee pad disposed and structured for supporting engagement with the user's knees, concurrent to the substantially vertical, upright orientation.

4. The exercise assembly as recited in claim 3 further comprising a connector structure movably interconnecting said handle to each of said at least two drive sections.

5. The exercise assembly as recited in claim 4 wherein said connector structure and each of said at least two drive sections are cooperatively structured to be independently and concurrently disposed in driving engagement with said resistance device dependent, at least in part, on a selected one of said plurality of different rowing motions of said handle.

6. The exercise assembly as recited in claim 4 wherein said connector structure comprises at least two connector members each disposed in interconnecting relation between said handle and a different one of said drive sections.

7. The exercise assembly as recited in claim 6 wherein at least one of said plurality of different rowing motions of said handle comprises each of said at least two drive sections alternatively connected in driving relation to said resistance device and in driven relation to interconnected ones of said connector members.

8. The exercise assembly as recited in claim 3 wherein said user support is connected to said housing.

9. The exercise assembly as recited in claim 1 wherein said convex configuration extends along at least a majority of a length of said outer surface.

10. The exercise assembly as recited in claim 1 wherein said convex configuration defines said movable engagement of said outer surface with the supporting surface as a reciprocal, substantially rocking movement of said seat section on the supporting surface.

11. The exercise assembly as recited in claim 1 wherein said receiving surface comprises a concave configuration dimensioned to define a substantially mating engagement with said convex configuration of said outer surface.

12. The exercise assembly as recited in claim 1 further comprising an attachment assembly disposed on both said outer surface and said receiving surface, said attachment assembly structured to removably and fixedly retain said seat section on said retaining section.

13. An exercise assembly structured to perform different exercise routines, said exercise assembly comprising:

a housing including a resistance device movably disposed in said housing, said resistance device structured to resist predetermined movement of said resistance device in said housing, a drive assembly connected in driving relation to said resistance device, a handle connected in driving relation to said drive assembly, said handle movable by a user through a plurality of different exercise motions, a user support comprising a seat section structured to support the user in a seated orientation and including a base configured for movable support of the user on a supporting surface, said user support further comprising a retaining section disposable in a removable, fixed position on the supporting surface, concurrent to a fixed retaining engagement with said seat section, said base including an outer surface having a convex configuration disposed in movable engagement with the supporting surface, concurrent to the seated orientation of the user, and said retaining section including a receiving surface disposed in retaining engagement with said outer surface of said base.

14. The exercise assembly as recited in claim 13 wherein said convex configuration defines said movable engagement of said outer surface with the supporting surface as a reciprocal, substantially rocking movement of said seat section on the supporting surface.

15. The exercise assembly as recited in claim 13 wherein said receiving surface comprises a concave configuration dimensioned to define a substantially mating engagement with said convex configuration of said outer surface.

* * * * *